US005877728A

United States Patent [19]

Wu et al.

[11] Patent Number: 5,877,728

[45] Date of Patent: Mar. 2, 1999

[54] MULTIPLE LOOP ANTENNA

[75] Inventors: Wen-Liang Wu, Thorofare; Alan Dutcher, West Deptford, both of N.J.

[73] Assignee: Checkpoint Systems, Inc., Thorofare, N.J.

[21] Appl. No.: 864,497

[22] Filed: May 28, 1997

[51] Int. Cl.[6] ..... H01Q 11/12; H01Q 21/00; G08B 13/14

[52] U.S. Cl. ..... 343/742; 340/572; 343/867

[58] Field of Search ..... 343/867, 742, 343/894; 340/572

[56] References Cited

U.S. PATENT DOCUMENTS

| | | | |
|---|---|---|---|
| Re. 29,610 | 4/1978 | Minasy et al. | 340/280 |
| 4,016,553 | 4/1977 | Novikoff et al. | 340/572 |
| 4,171,525 | 10/1979 | Seeley | 343/853 |
| 4,373,163 | 2/1983 | Vanderbult | 343/842 |
| 4,394,645 | 7/1983 | Humble et al. | 340/572 |
| 4,413,254 | 11/1983 | Pinneo | 340/572 |
| 4,642,613 | 2/1987 | Pokalsky | 340/572 |
| 4,679,035 | 7/1987 | Pfaff et al. | 340/572 |
| 4,700,179 | 10/1987 | Fancher | 340/572 |
| 5,305,002 | 4/1994 | Holodak et al. | 343/788 |
| 5,459,451 | 10/1995 | Crossfield et al. | 340/572 |
| 5,519,381 | 5/1996 | Marsh et al. | 340/572 |
| 5,585,811 | 12/1996 | Jetzer | 343/867 |
| 5,602,556 | 2/1997 | Bowers | 343/742 |

*Primary Examiner*—Don Wong
*Assistant Examiner*—Jennifer H. Malos
*Attorney, Agent, or Firm*—Panitch Schwarze Jacobs & Nadel, P.C.

[57] ABSTRACT

A multiple loop antenna is provided which may be connected to either a transmit circuit, a receive circuit, or a transmit/receive circuit. When powered by a transmit circuit, the antenna generates radio frequency magnetic fields in an area or zone proximate to the antenna, but which are substantially canceled at a distance approximately one wavelength and more from the antenna, thereby defining a surveillance zone proximate to the antenna. The loop antenna includes a first, upper loop and a second, lower loop. The upper and loser loops lie in separate, spaced, parallel planes and are preferably disposed at a fixed angle with respect to the surveillance zone.

25 Claims, 2 Drawing Sheets

MULTIPLE LOOP ANTENNA

BACKGROUND OF THE INVENTION

The present invention relates to radio frequency antennas and more particularly, to loop antennas which generate fields that are generally canceling at distances of one wavelength or more from the antenna.

In certain known types of electronic systems it is known to provide one or more loop antennas wherein coupling between an antenna and its proximate surrounding is high, but wherein the design of the antenna is such that coupling between the antenna and its distant surrounding (i.e., about one wavelength or more distant from the antenna) is minimized. Such antennas are generally used for near-field communications or sensing applications where the term "near field" means within one half wavelength from the antenna. Examples of such applications include communications with implanted medical devices, short range wireless local area communications networks for computers and radio frequency identification systems including electronic article surveillance (EAS) systems. Generally, the coupling to these loop antennas is primarily via magnetic induction.

For example, radio frequency EAS systems usually include both a transmit antenna and a receive antenna which collectively establish a surveillance zone, and tags which are attached to articles being protected. The transmit antenna generates a variable frequency electromagnetic field within a range of a first predetermined frequency. The tags each include a resonant circuit having a predetermined resonant frequency generally equal to the first frequency. When one of the tags is present in the surveillance zone, the field generated by the transmit antenna induces a voltage in the resonant circuit in the tag, which causes the resonant circuit to generate an electromagnetic field, causing a disturbance in the field within the surveillance zone. The receive antenna detects the electromagnetic field disturbance and generates a signal indicating the presence of the tag (and thus, the protected article attached to the tag) in the surveillance zone.

The design of these antennas should satisfy two objectives: (1) to maximize the coupling to the tag over as wide a distance between the transmit and receive antennas as possible, and (2) to minimize the coupling to the far-field. These are conflicting objectives. Prior art antennas, such as those described by Lichtblau in U.S. Pat. Nos. 4,243,980, 4,260,990 and 4,866,455, herein incorporated by reference, generally incorporate two or more co-planar loops such that in combination the sizes of each loop, the magnitude of the currents within the loops and the direction of the currents generate fields which, when measured at a point distant from the antenna, generally cancel. In other words, the fields created from each of the loops, when summed, net a field which approaches zero. Such far-field cancellation is not possible when only one loop is used. In figure-eight loop antennas, the loops are generally rectangular, arranged in a coplanar configuration, and offset in position such that at least one side of each loop is proximate to a side of another loop. In other words, the shared sides are immediately adjacent to each other.

The present invention provides an antenna having both much reduced far-field coupling properties and increased coupling in a wide area between a transmit antenna and a receive antenna. Generally, the antenna (either transmit or receive) comprises first and second loops of generally equal dimensions and shape wherein the loops are disposed in a fixed position on opposite sides of a central axis extending between the loops. Further, the loops are positioned in separate, spaced, parallel planes. The loops are connected to each other and to either a transmit circuit or a receive circuit by a crossover conductor. Preferably, a length of the crossover conductor from the first loop to the (transmit or receive) circuit is equal to a length of the crossover conductor from the second loop to the circuit. The current in the loops flows in opposite directions and thereby generates substantially canceling fields. The present invention provides an antenna which is highly sensitive to externally emitted signals within a zone proximate to the antenna and highly insensitive to distant emitted signals.

SUMMARY OF THE INVENTION

Briefly stated, the present invention comprises a multiple loop antenna comprising:

- a first loop element;
- a second loop element, wherein the first and second loop elements are of generally equal dimensions and lie in separate, spaced, generally parallel planes; and
- a crossover element comprising an electrical conductor for electrically connecting the first and second loop elements.

The present invention is also directed to an electronic article surveillance system comprising:

- a transmit circuit element;
- a transmit antenna electrically coupled to the transmit circuit element for generating electromagnetic fields, the transmit antenna comprising first and second loop elements of generally equal dimensions, the loop elements being in generally separate, spaced, parallel planes and a crossover conductor electrically coupling together the first and second loop elements;
- a receive antenna spaced from the transmit antenna, the receive antenna comprising first and second loop elements of generally equal dimensions, the loop elements being in generally separate, spaced, parallel planes and a crossover conductor electrically coupling together the first and second loop elements, wherein the receive antenna is essentially the same size as the transmit antenna, and wherein a surveillance zone is defined between the transmit antenna and the receive antenna; and
- a receive circuit element electrically coupled to the receive antenna for detecting resonance of a resonant tag in the surveillance zone at a predetermined frequency and generating an alarm signal therefrom indicative of the presence of a protected article in the surveillance zone.

In a preferred embodiment, the present invention is an electronic article surveillance system comprising:

- a transmit circuit element;
- a transmit antenna electrically coupled to the transmit circuit element for generating electromagnetic fields, the transmit antenna comprising first and second loop elements of generally equal dimensions, the loop elements being in generally separate, spaced, parallel planes and a crossover conductor electrically coupling together the first and second loop elements;
- a receive antenna spaced from the transmit antenna, the receive antenna comprising first and second loop elements of generally equal dimensions, the loop elements being in generally separate, spaced, parallel planes and a crossover conductor electrically coupling together the first and second loop elements, wherein the receive antenna is essentially the same size as the transmit antenna, wherein a horizontal axis extending generally through the geometric center of the transmit antenna separates the first and second loop elements of each of the transmit antenna and the receive antenna such that the first and second loop elements of each respective antenna are located on opposing sides of the horizontal axis and wherein a surveillance zone is defined between the transmit antenna and the receive antenna, the surveillance zone comprising an aisle extending between the transmit antenna and the receive antenna, wherein each of the loop elements of the transmit antenna and the receive antenna are fixed at a predetermined angle with respect to the aisle; and a receive circuit element electrically coupled to the receive antenna for detecting resonance of a resonant tag in the surveillance zone at a predetermined frequency and generating an alarm signal therefrom indicative of the presence of a protected article in the surveillance zone.

BRIEF DESCRIPTION OF THE DRAWINGS

The foregoing summary, as well as the following detailed description of a preferred embodiment of the present invention, will be better understood when read in conjunction with the appended drawings. For the purpose of illustrating the present invention, there is shown in the drawings an embodiment which is presently preferred. It should be understood, however, that the present invention is not limited to the particular arrangement and instrumentalities shown. In the drawings.

DETAILED DESCRIPTION OF PREFERRED EMBODIMENTS

Figure 1:
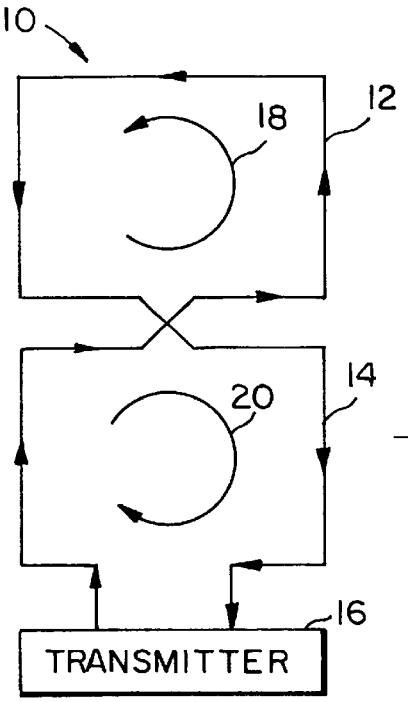
FIG. 1 (PRIOR ART)
FIG. 1 is a schematic diagram of a prior art far-field canceling antenna.

Certain terminology is used in the following description for convenience only and is not limiting. The words "top", "bottom", "lower" and "upper" designate directions in the drawings to which reference is made. The terminology includes the words above specifically mentioned, derivatives thereof and words of similar import.

The present invention is directed to an antenna which can transmit and receive electromagnetic energy primarily via magnetic induction, wherein the size of the antenna is substantially less than the wavelength of the transmitted or received electromagnetic energy. The antenna of the present invention is well suited for use in systems where coupling of energy from or to the antenna primarily occurs proximate (i.e. within less than one-half wavelength) the antenna. An example of such a system is an EAS system where the antenna is used to establish a surveillance zone. Of course, such an antenna has many other uses as will be apparent to those of skill in the art and the EAS system is but an illustrative example of a use of the antenna.

In an EAS system, the antenna is used to activate a resonant circuit in a security tag and then detect such tag. A security tag (not shown) for use with the present invention is generally of a type which is well known in the art of EAS systems. The tag is adapted to be secured or otherwise borne by an article or item, or the packaging of such article for which security or surveillance is sought. The tag may be secured to the article or its packaging at a retail or other such facility, or secured or incorporated into the article or its packaging, by the manufacturer or wholesaler of the article. The security tag includes components which establish a resonant circuit that resonates when exposed to electromagnetic energy at or near a predetermined detection resonant frequency. Such tags employed in connection with EAS systems, particularly a radio frequency or RF type EAS system, are known in the art and, therefore, a complete description of the structure and operation of such tags is not necessary for an understanding of the present invention. Suffice it to say that such tags resonate or respond when located within a surveilled area or zone, generally proximate to an entrance or exit of a facility, such as a retail store. The resonating tag is then detected by the security system, which activates an alarm to inform personnel that the tag is in the surveilled zone.

Referring now to the drawings in detail, wherein like numerals indicate like elements throughout, there is shown in FIG. 1 a schematic diagram of a prior art far-field canceling antenna 10 of an EAS system for generating and/or coupling to electromagnetic fields, which is disclosed in detail in U.S. Pat. No. 4,243,980 assigned to Checkpoint Systems, Inc. of Thorofare, N.J., the disclosure of which is incorporated herein by reference. Generally, the antenna 10 comprises a first, upper loop 12 and a second, lower loop 14, with the upper and lower loops 12, 14 being coplanar. The upper and lower loops 12, 14 are of generally equal dimensions and are generally in the shape of a quadrilateral, such that the overall shape of the combined upper and lower loops 12, 14 is generally rectangular.

The antenna 10 includes a transmitter 16 for supplying a current to the upper and lower loops 12, 14 such that the upper and lower loops 12, 14 radiate electromagnetic fields. The transmitter 16 is connected to the upper and lower loops 12, 14 such that the current flows in the upper loop 12 in a first direction, counter-clockwise as shown by arrow 18, and in the lower loop 14 in a second direction, clockwise as shown by arrow 20, which is opposite to the direction of the current flow in the upper loop 12. It will be understood by those of ordinary skill in the art that the direction of the current flow is representative of only an instant in time. That is, the current flows in the opposite direction during the next half cycle. However, the relative direction of the currents between the upper and lower loops 12, 14 with respect to each other is maintained. As is also known to those of ordinary skill in the art and as previously discussed, the opposing currents generate magnetic fields of generally equal magnitudes but opposite in direction such that the fields substantially cancel in the far-field (i.e., an area multiple wavelengths away from the antenna). For an antenna operating at 8.2 MHZ, the Federal Communications Commission (FCC) defines the far-field as an area thirty meters or slightly less than one wavelength from the antenna. The transmitter 16 is conventional and known to those of ordinary skill in the art.

In an EAS system, a receive antenna (not shown) of generally equivalent dimensions and configuration as the transmit antenna 10, is placed proximate to the antenna 10 for creating a surveillance zone therebetween. According to the present invention, the transmit and receive antennas each comprise first and second loop elements of generally equal dimensions and shape. The first and second loop elements, which are connected to each other with a crossover conductor, are positioned in separate, spaced, parallel planes. When connected to a transmitter, the antenna has both much reduced far-field coupling properties and increased coupling in a wide area between a transmit antenna and a receive antenna. Thus, the antenna of the present invention is well suited for EAS applications.

Figure 2:
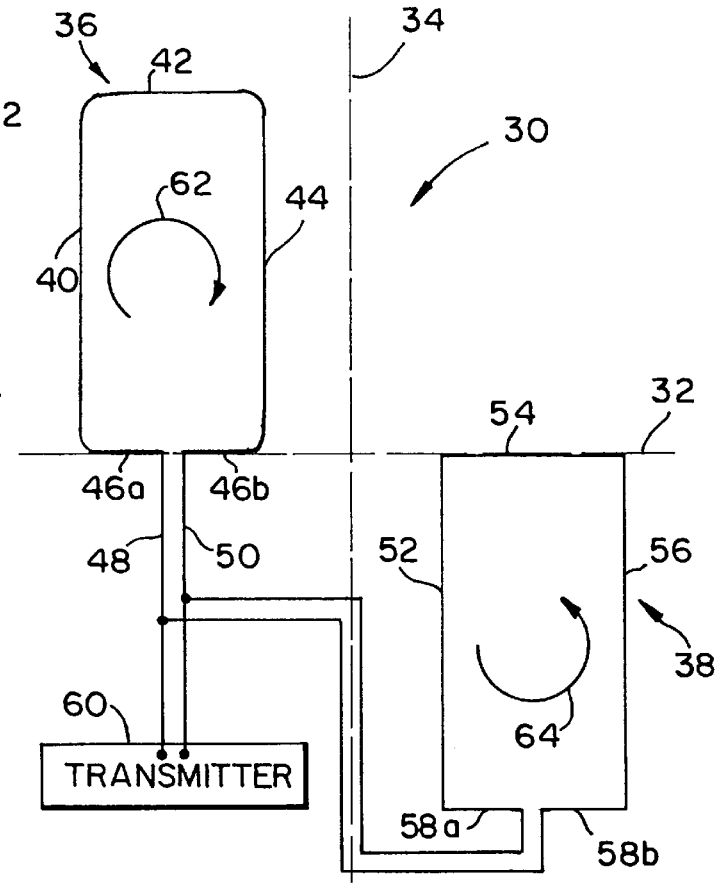
FIG. 2 is a schematic diagram of a far-field canceling antenna in accordance with the present invention.

Referring now to FIG. 2, a schematic block diagram of an improved loop antenna 30 in accordance with the present invention is shown. FIG. 2 includes a horizontal axis 32 and a vertical axis 34, each extending generally through the geometric center of the antenna 30 in order to more clearly describe and depict the shape and dimensions of the antenna 30. The antenna 30 basically comprises a first or upper loop element 36 located primarily above the horizontal axis 32 and a second or lower loop element 38 located primarily below the horizontal axis 32. As shown in FIG. 2 and as is preferred, the upper and lower loop elements 36, 38 are of generally equivalent size and shape, and lie in separate, spaced, generally parallel planes. In the presently preferred embodiment, the first and second loop elements are spaced from each other by about 18 to 22 inches. Of course, it will be understood by those of ordinary skill in the art that distances of either greater than or less than 18–22 inches between the upper and lower loop elements 36, 38 may be used with the present invention.

The upper loop element 36 and the lower loop element 38 each preferably comprise one or more turns of a conductor or wire of any suitable type, such as different gauge size conductors, which conductors are known to those of ordinary skill in the art. Preferably the upper and lower loop elements 36, 38 are constructed or formed from a single wire. However, it will be appreciated that other conducting elements, such as a multiconductor wire, may be used, if desired, without departing from the scope of the present invention. For example, it may be desirable to use mechanically functional structural elements to make up the first and second loop elements 36, 38. Alternatively, electrically conductive decorative elements (not shown) may be used.

Although the loop elements 36, 38 are designated as "upper" and "lower" loop elements, respectively, it will be apparent to those of ordinary skill in the art that the descriptive terms "upper" and "lower" are relative, and that the loop elements 36, 38 could be oriented in other orientations with respect to each other.

The upper loop element 36 is generally in the shape of a rectangle having a first side 40 which is generally parallel to the vertical axis 34, a second side 42 which is generally parallel to the horizontal axis 32, 25 a third side 44 which is parallel to the first side 40 and extending from the second side 42, and a fourth side 46 comprising two separate parts, 46*a*, 46*b*.

Similarly, the lower loop element 38 is also generally in the shape of a rectangle having a first side 52 which is generally parallel to the vertical axis 34, a second side 54 which is generally parallel to the horizontal axis 32, a third side 56 which is generally parallel to the first side 52 and extending from the second side 54, and a fourth side 58 comprising two separate parts, 58*a*, 58*b*.

A crossover element comprising a pair of conductors 48, 50 extends from the respective parts 46*a*, 46*b* of the fourth side 46 of the upper loop element 36 and electrically connects the upper loop element 36 with the parts 58*a*, 58*b*, respectively, of the fourth side 58 of the lower loop element 38. The crossover element conductors 48, 50 preferably comprise a pair of closely-spaced wires or conductors, such as a twisted pair of wires or a parallel shielded cable, and have a predetermined length to connect the upper and lower loop elements 36, 38. Preferably, the crossover conductors 48, 50 extend from a position proximate to the horizontal axis 32 to below the horizontal axis 32. Since the upper and lower loop elements 36, 38 lie in spaced, parallel planes, the crossover conductor, in addition to extending vertically, also extends horizontally between the upper and lower loop elements 36, 38. Although it is preferred that the upper and lower loop elements 36, 38 are connected as shown, it is understood that the upper and lower loops 36, 38 could also be connected by connecting other sides of the respective loop elements 36, 38 to each other. For instance, the fourth side 46 of the upper loop element 36 could be connected to the second side 54 of the lower loop element 38, or the third side 44 of the first loop element 36 could be connected to the first side 52 of the second loop element 38.

Although each of the upper and lower loop elements 36, 38 is shown as a rectangle, it is not required that the upper and lower loop comprise a rectangle, but only that the upper and lower loop elements 36, 38 are of generally similar size and geometric shape. For instance, the upper and lower loop elements 36, 38 could comprise other geometric shapes, such as circular, oval, or triangular.

The antenna 30 can be electrically coupled to and driven by an electrical device or circuit, which can be transmitter circuitry in the case of a transmitting antenna, receiver circuitry in the case of a receive antenna, or a transmitter/receiver circuit in the case of an antenna designed for bidirectional communications. In the case of a transmit antenna, the electrical circuit element may comprise a current source electrically coupled to the antenna for supplying current to the antenna sufficient for developing electromagnetic fields. For instance, the electrical circuit could be a conventional transmitter comprising a signal oscillator (not shown) and a suitable amplifier/filter network (not shown) of a type capable of driving the load impedance presented by the antenna. In FIG. 2, a transmitter 60 is connected to the crossover conductors 48, 50 of the antenna 30.

The transmitter 60 is connected to each of the crossover conductors 48, 50 such that the transmitter 60 supplies current to the upper and lower loop elements 36, 38 with the current flowing in opposite directions in the upper and lower loop elements 36, 38, as indicated by arrows 62, 64, respectively. Current in the upper loop element 36 flows in a clockwise direction while current flowing in the lower loop element 38 flows in the counter-clockwise direction. As previously discussed, multiple loops with current flowing in opposite directions in the loops provide very effective far-field cancellation.

Preferably, the size of the antenna 30 is substantially less than a wavelength of operation of the antenna 30 such that the antenna 30 primarily generates magnetic fields. For instance, the first and third sides 40, 44 and 52, 56 of the first and second loop elements 36, 38, respectively, may be about 30–40 inches in length and the second side 42, 54 of the first and second loop elements 36, 38, respectively, may be about 1–15 inches. However, it will be understood by those of ordinary skill in the art that the size of the loop elements 36, 38 may vary with the application and the desired size of the surveillance zone. In a preferred embodiment of the invention, the lower loop element 38 is about 2.0 inches above ground level and each of the upper and lower loop elements 36, 38 has a length of about 32 inches and a width of about 5.6 inches. It will be further understood by those of ordinary skill in the art that the upper and lower loop elements 36, 38 could even have different sizes and the desired far-field canceling could be achieved by varying the value of the current in each of the loop elements 36, 38.

As will be appreciated, the frequency at which the antenna radiates electromagnetic fields substantially depends on the oscillation rate of the transmitter 60. Thus, the frequency may be set and adjusted by appropriately adjusting the transmitter 60 in a well-known manner. Preferably, the antenna 30 is operative at radio frequencies, which preferably include frequencies above 1,000 Hz, and more preferably include frequencies above 5,000 Hz, and even more preferably include frequencies above 10,000 Hz. However, it should be understood that the antenna 30 could be operated at lower frequencies without departing from the scope of the present invention. In the presently preferred embodiment, the tag preferably resonates at or near 8.2 MHz, which is one commonly employed frequency used by electronic security systems from a number of manufacturers, although it will be apparent to those of ordinary skill in the art that the frequency of the EAS system may vary according to local conditions and regulations. Thus, this specific frequency is not to be considered a limitation of the present invention.

Alternatively, the electrical circuit may comprise receiver circuitry (not shown) electrically coupled to the antenna 30 for receiving electromagnetic energy from a transmitting antenna and/or the resonant circuit of a tag (not shown) for generating a signal indicative of whether a tag is present in the vicinity of the antenna. Such electrical circuit elements for transmitting and/or receiving are generally known. For example, such circuit elements are described in U.S. Pat. No. 5,373,301. A more detailed description of the electrical circuit element is not required to understand the present invention.

In the presently preferred embodiment, a receiver circuit used with the present invention includes an alarm circuit, as is well known, for generating an alarm signal indicating that a resonant tag is located in the surveillance zone defined by the transmit and receive antennas. However, rather than causing a sharp beep or siren sound to be generated, the receiver circuit includes a storage device, such as a non-volatile RAM or a programmable ROM for storing a predetermined custom alarm signal, such as a well known song or jingle, or portions thereof. Alternatively, a recording of a well known voice may be initiated. The use of such a custom audio signal, in contrast to prior art beeps and sirens, may be used to mask the alarm function of the receiver from a customer.

Preferably, a length of the crossover conductors 48, 50 measured from the upper loop element 36 to the electrical circuit element (e.g., the transmitter 60) is equal to a length of the crossover conductors 48, 50 measured from the lower loop element 38 to the electrical circuit element. Coupling the transmitter 60 essentially equidistant between the upper and lower loop elements 36, 38 contributes to providing equal currents through the equivalent conductor segments that comprise the crossover and loops 36, 38 of the antenna 30, thereby obtaining precise cancellation of the fields at a distance from the antenna 30. Thus, far-field coupling is minimized. In a reciprocal fashion, when connected to a receiver, the sensitivity of the antenna 30 to signals at a distance from the antenna 30 is minimized.

The antenna 30 is designed to maximize the magnetic coupling coefficient of the antenna 30 in as large a zone as possible proximate to the antenna 30. Separating the lower loop element 38 from the upper loop element 36 such that the loop elements 36, 38 are not coplanar, has been found to provide better overall coupling to tags within the surveillance zone for EAS applications, and therefore better overall detection of the tags.

Figure 3:
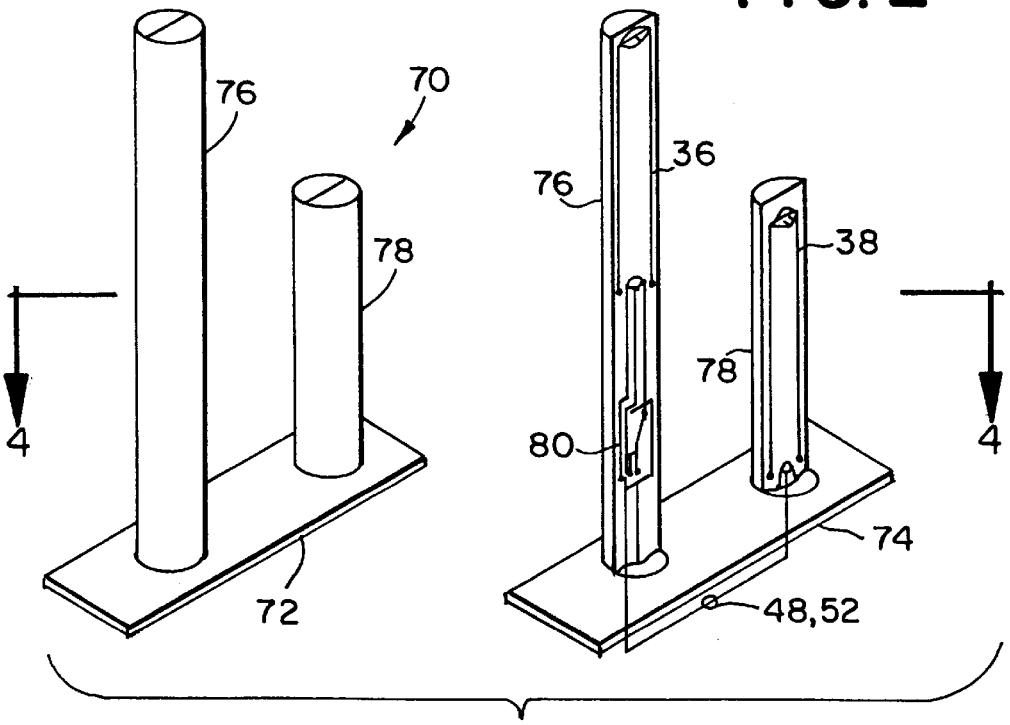
FIG. 3 is a schematic diagram of a far-field canceling antenna in use in an EAS system having a first antenna shown in a housing and a partial cross-sectional view of a second antenna in a housing, in accordance with the present invention.

Referring now to FIG. 3, an EAS system 70 is shown comprising a transmit antenna housed within a decorative structure 72 and a receive antenna housed within a second decorative structure 74. Preferably the decorative structures 72, 74 are constructed of a non-conductive material, such as a polymeric material and provide a rigid support structure for housing the antenna loop elements. The decorative structures 72, 74 each preferably comprise first and second separate columnar shaped housings 76, 78 for housing the upper and lower loop elements 36, 38, respectively. The first columnar housing 76 also houses a printed circuit board (PCB) 80 and its associated electronic components which comprise either the transmitter 60 or the receiver. That is, the upper loop element 36 is located in the top or upper half of the housing 76 and the PCB 80 is located in the lower or bottom half of the housing 76. The crossover conductor 48, 50 extends between the columnar housings 76, 78 to connect the upper and lower loop elements 36, 38 and the electrical circuit element.

Of course, it is not required that separate housings be used for the upper and lower loop elements 36, 38, as such elements could be housed within a single structure. Moreover, one or more cross bars (not shown) could be placed between the housings 76, 78 to add structural support to the housings.

The decorative structures 72, 74 are generally placed on opposing sides of an entry/exit of a store and the aisle between the structures 72, 74 is the surveillance zone. Thus, resonant tags or markers which are active and which pass between the structures 72, 74 activate the alarm signal.

Figure 5:
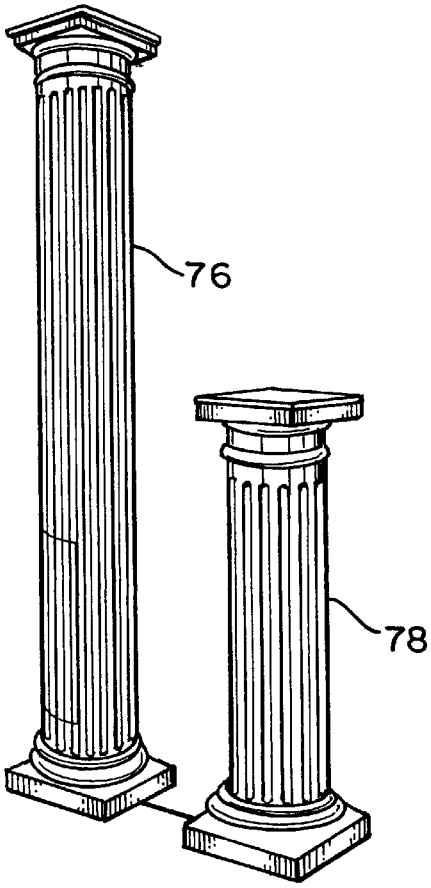
FIG. 5 is a perspective view of an antenna of the present invention in a decorative housing.

FIG. 5 is a perspective view of a preferred embodiment of decorative columnar housings 76, 78 which may be used with the present invention. Such columnar housings may simulate Greek columns and be used as plant stands. Thus, the EAS system is attractive and unobtrusive.

Typically, the spacing in an EAS system between the transmit antenna and receive antenna is in the range of from two to five feet depending upon the particular EAS system and the particular application in which the system is being employed. The aforedescribed antenna design provides a larger surveillance zone then prior art antennas. For instance, EAS systems are usually located at an entry/exit of a retail store, with a typical system having a transmit antenna located on a first side of the entry/exit and a receive antenna located on a second, opposite side of the entry/exit. In order to avoid inhibiting entry/exit to the establishment, it is desirable that the antennas be spaced from each other by at least the width of the entry/exit, which is generally about six feet.

Unfortunately, many prior art systems require the transmit and receive antennas to be spaced from each other at a distance of much less than six feet, and even less than five feet, requiring persons to be funneled through a space more narrow than the entry/exit, or for more than two antennas to be used at the entry/exit. However, due to the excellent far field canceling properties of the antenna design of the present invention, a transmitter connected to the antenna may be operated at a very high power without creating far field emissions that violate FCC regulations.

In addition, since a signal generated by a tag in a surveillance zone of the antenna is proportional in amplitude to the amplitude of the signal used to drive the antenna a net increase in the tag signal is achieved, which provides a corresponding increase in the signal to noise ratio of the system. This increase in the signal to noise ratio allows a transmit antenna to be located further from a receive antenna than present EAS systems. For instance, the transmit and receive antennas may be located on opposite sides of a standard six foot store entry, which allows customers to pass more easily into and out of the store. That is, the antenna design of the present invention allows the transmit and receive antennas to be spaced greater than six feet apart and still detect tags passing therebetween. The aisle width may also be enhanced by placing receive antennas on opposing sides of the transmit antenna, thereby defining two aisles.

Of course, as will be understood by those of ordinary skill in the art, the size of the resonant tag or marker is also a factor in determining the spacing between the transmit and receive antennas. For instance, an EAS system using a relatively large tag permits the transmit and receive antennas to be placed farther apart than a system required to detect a relatively small tag. However, according to the present invention, the transmit and receive antennas may be spaced a distance of greater than six feet apart and still detect both large and small tags.

Figure 4:
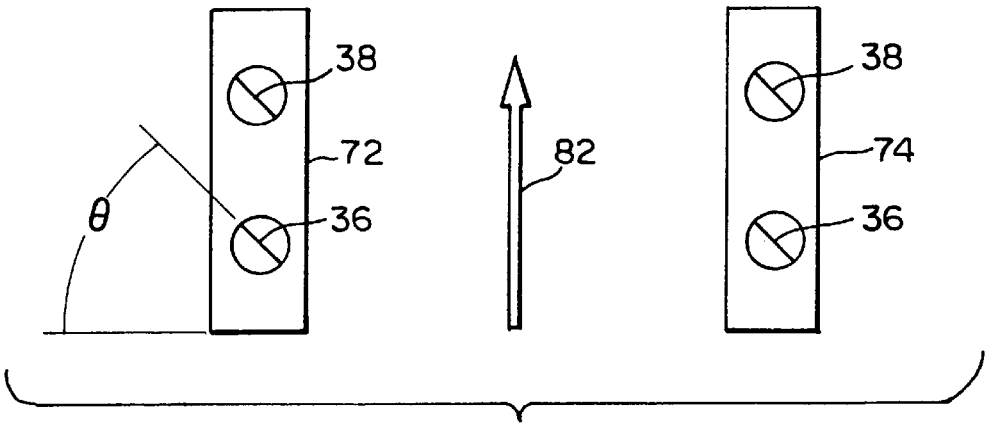
FIG. 4 is a cross-sectional view of the EAS system of FIG. 3 along lines 4—4.

FIG. 4 is a cross-sectional view of the EAS system 70 of FIG. 3 along lines 4—4. The aisle or surveillance zone has an arrow 82 indicating a direction a person would travel to exit a store using the EAS system 70. Preferably, the upper and lower loop elements 36, 38 of each of the transmit antenna and the receive antenna are fixed at a predetermined angle θ with respect to the aisle. The angle θ is preferably less than 90°, and more preferably, is about 45°. Note that the loop elements 36, 38 are fixed, and do not move or change position, as do known prior art antennas which have been mounted in doors or similar structures.

Although particular embodiments of the present invention have been described, it will be apparent that the present invention may be altered or modified, yet still provide the desired far-field cancellation without departing from the scope and spirit of the invention. Moreover, although the antennas of the present invention are described herein with reference to EAS systems, it will be appreciated that such reference to EAS systems is provided for illustrative purposes only and is not limiting. The antennas of the present invention are well suited for use in many other types of applications, and more particularly, have application in any area in which the electromagnetic energy radiated by the antenna is used to perform a communication or identification function. For instance, the antennas of the present invention can be used in conjunction with a sensor (which is powered, by the electromagnetic energy transmitted by the antenna) in an environment where it is difficult to power or otherwise communicate with the sensor via wires connected to the sensor. In this environment, the antenna could be used to remotely power and receive information from the sensor. For example, the antenna of the present invention could be used in conjunction with a sensor which measures a patient's blood sugar level, wherein the blood sugar level sensor is subcutaneously implanted into a patient's tissue. As will be appreciated, it is highly desirable that the patient's skin not be punctured with wires to connect to the sensor. It is also highly desirable to eliminate batteries from the sensor. With the present invention, it is possible to use the electromagnetic energy generated by the antenna to power the sensor located beneath the patient's skin and to simultaneously use the antenna to receive the electromagnetic energy transmitted by the sensor, where the electromagnetic energy transmitted by the sensor relates to the patient's blood sugar level. Another application is related to communicating with a passive transponder that identifies its owner for access control. Other useful applications of the present invention will also be apparent to those skilled in the art.

It will further be recognized by those skilled in the art that changes may be made to the above-described embodiments of the present invention without departing from the inventive concepts thereof. It is understood, therefore, that the present invention is not limited to the particular embodiments disclosed, but is intended to include all modifications and changes which are within the scope and spirit of the invention as defined by the appended claims.

We claim:

1. A multiple loop antenna comprising:

a first loop element;

a second loop element, wherein the first and second loop elements are of generally equal dimensions and lie in separate, spaced, generally parallel planes; and a crossover element comprising electrical conductors for electrically connecting the first and second loop elements.

2. The antenna of claim 1 wherein a horizontal axis extending generally through a center point between the first and second loop elements separates the first and second loop elements, such that the first and second loop elements are located on opposing sides of the horizontal axis.

3. The antenna of claim 2 wherein a vertical axis extending generally through a center point between the first and second loop elements separates the first and second loop elements, such that the first and second loop elements are located on opposing sides of the vertical axis.

4. The antenna of claim 1 wherein the first and second loop elements are spaced from each other by about 18 to 22 inches.

5. The antenna of claim 1 further comprising an electrical circuit element connected to the first and second loop elements.

6. The antenna of claim 5 wherein the crossover element connects the first and second loop elements to the electrical circuit element.

7. The antenna of claim 6 wherein a length of the crossover element connecting the first loop element to the electrical circuit element is generally equal to a length of the crossover element connecting the second loop element to the electrical circuit element.

8. The antenna of claim 7 wherein the circuit element comprises a transmitter.

9. The antenna of claim 8 wherein a current generated by the transmitter flows in a first direction in the first loop element and in a second direction, opposite to the first direction, in the second loop element.

10. The antenna of claim 9 wherein fields generated by the currents flowing through the first and second loop elements are generally canceling at distances of one wavelength or more from the antenna.

11. The antenna of claim 5 wherein the circuit element comprises a receiver.

12. The antenna of claim 1 wherein the size of the antenna is substantially less than a wavelength of operation of the antenna such that the antenna primarily generates magnetic fields.

13. The antenna of claim 1 further comprising a rigid support structure for housing the first and second loop elements.

14. The antenna of claim 13 wherein the each of the first and second loop elements are housed in a separate support structure.

15. An electronic article surveillance system comprising:

a transmit circuit element;

a transmit antenna electrically coupled to the transmit circuit element for generating electromagnetic fields, the transmit antenna comprising first and second loop elements of generally equal dimensions, the loop elements being in generally separate, spaced, parallel planes and a crossover conductor electrically coupling together the first and second loop elements;

a receive antenna spaced from the transmit antenna, the receive antenna comprising first and second loop elements of generally equal dimensions, the loop elements being in generally separate, spaced, parallel planes and a crossover conductor electrically coupling together the first and second loop elements, wherein the receive antenna is essentially the same size as the transmit antenna, and wherein a surveillance zone is defined between the transmit antenna and the receive antenna; and a receive circuit element electrically coupled to the receive antenna for detecting resonance of a resonant tag in the surveillance zone at a predetermined frequency and generating an alarm signal therefrom indicative of the presence of a protected article in the surveillance zone.

16. The electronic article surveillance system of claim 15 wherein a horizontal axis extending generally through a center point between the first and second loop elements of the transmit antenna separates the first and second loop elements of the transmit antenna, such that the first and second loop elements of the transmit antenna are located on opposing sides thereof.

17. The electronic article surveillance system of claim 16 wherein the horizontal axis also separates the first and second loop elements of the receive antenna, such that the receive antenna first and second loop elements are also located on opposing sides of the horizontal axis.

18. The electronic article surveillance system of claim 15 wherein a vertical axis extending generally through a center point between the first and second loop elements of the transmit antenna separates the first and second loop elements of the transmit antenna, such that the first and second loop elements of the transmit antenna are located on opposing sides thereof.

19. The electronic article surveillance system of claim 18 wherein the vertical axis also separates the first and second loop elements of the receive antenna, such that the receive antenna first and second loop elements are also located on opposing sides of the vertical axis.

20. The electronic article surveillance system of claim 15 wherein the surveillance zone comprises an aisle extending between the transmit antenna and the receive antenna, and wherein each of the loop elements of the transmit antenna and the receive antenna are fixed at a predetermined angle with respect to the aisle.

21. The electronic article surveillance system of claim 20 wherein the angle comprises about 45°.

22. The electronic article surveillance system of claim 15 wherein the receiver circuit includes an alarm circuit for generating the alarm signal.

23. The electronic article surveillance system of claim 22 wherein the alarm signal initiates a customized audio signal.

24. The electronic article surveillance system of claim 15 wherein the aisle is greater than about six feet wide.

25. An electronic article surveillance system comprising:

a transmit circuit element;

a transmit antenna electrically coupled to the transmit circuit element for generating electromagnetic fields, the transmit antenna comprising first and second loop elements of generally equal dimensions, the loop elements being in generally separate, spaced, parallel planes and a crossover conductor electrically coupling together the first and second loop elements;

a receive antenna spaced from the transmit antenna, the receive antenna comprising first and second loop elements of generally equal dimensions, the loop elements being in generally separate, spaced, parallel planes and a crossover conductor electrically coupling together the first and second loop elements, wherein the receive antenna is essentially the same size as the transmit antenna, wherein a horizontal axis extending generally through the geometric center of the transmit antenna separates the first and second loop elements of each of the transmit antenna and the receive antenna such that the first and second loop elements of each respective antenna are located on opposing sides of the horizontal axis and wherein a surveillance zone is defined between the transmit antenna and the receive antenna, the surveillance zone comprising an aisle extending between the transmit antenna and the receive antenna, wherein each of the loop elements of the transmit antenna and the receive antenna are fixed at a predetermined angle with respect to the aisle; and a receive circuit element electrically coupled to the receive antenna for detecting resonance of a resonant tag in the surveillance zone at a predetermined frequency and generating an alarm signal therefrom indicative of the presence of a protected article in the surveillance zone.

* * * * *